United States Patent [19]

Kohlen et al.

[11] 4,088,455

[45] May 9, 1978

[54] PROCESS AND APPARATUS FOR A PRESSURE GASIFICATION OF FUELS MAINLY IN LUMP FORM

[75] Inventors: Rudolf Kohlen, Wehrheim; Gerhard Baron, Hofheim; Herbert Bierbach; Carl Hafke, both of Frankfurt am Main, all of Germany

[73] Assignee: Metallgesellschaft Aktiengesellschaft, Frankfurt am Main, Germany

[21] Appl. No.: 771,122

[22] Filed: Feb. 22, 1977

[30] Foreign Application Priority Data

Feb. 27, 1976 Germany ..... 2607964

[51] Int. Cl.[2] ..... C10J 3/16

[52] U.S. Cl. ..... 48/202; 48/206

[58] Field of Search ..... 48/68, 67, 66, 73, 76, 48/77, 63, 99, 105, 107, 202, 197 R, 206

[56] References Cited

U.S. PATENT DOCUMENTS

| | | | |
|---|---|---|---|
| 1,917,839 | 7/1933 | Haug | 48/66 |
| 2,216,792 | 10/1940 | Stryker | 48/DIG. 4 |
| 4,014,664 | 3/1977 | Kupfer et al. | 48/68 |

FOREIGN PATENT DOCUMENTS

| | | | |
|---|---|---|---|
| 775,157 | 5/1957 | United Kingdom | 48/67 |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

A process and apparatus for the continuous gasification of fuels, which are mainly in lump form. The fuels are subjected to a superatmospheric pressure in a fixed bed treatment with a gasifying agent consisting of gases which contain free oxygen and water vapor and/or carbon dioxide in a water-cooled reactor housing. The housing contains a substantially conical rotary grate, which is rotatably mounted in the lower portion of the reactor housing and serves to discharge the gasifying agent into the reactor shaft and permits the removal of gasification residue from the shaft. The gasifying agent is positively distributed in correspondence with the quantity of fuel, which increases in the radial direction of the shaft resulting in an approximately uniform time of contact between the gas and fuel across the entire shaft area.

6 Claims, 1 Drawing Figure

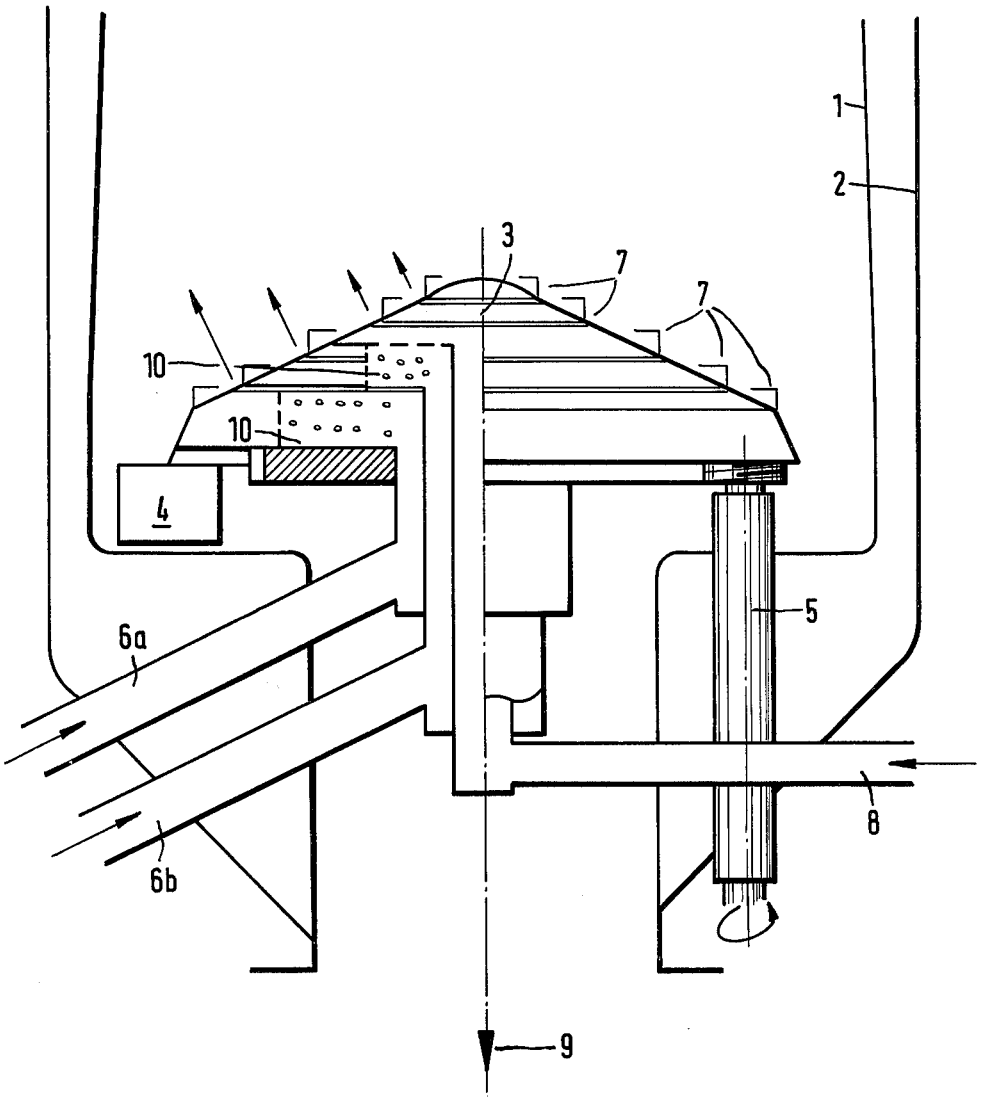
1
2
3
7
7
10
10
4
5
6a
6b
8
9

PROCESS AND APPARATUS FOR A PRESSURE GASIFICATION OF FUELS MAINLY IN LUMP FORM

BACKGROUND OF THE INVENTION

This invention relates to a reactor for continuous gasification of fuels which are mainly in the form of lumps, under superatmospheric pressure, in a water-cooled double-walled reactor chamber, by a treatment with a gasifying agent consisting of gases that contain free oxygen in a mixture with saturated or superheated water vapor and, if desired, other gases.

This invention constitutes a further development of the process and apparatus disclosed in U.S. Pat. No. 3,937,620. Further details of the pressure gasification of solid fuels and of the reactor required for that purpose are known from U.S. Pat. Nos. 2,667, 409; 3,930,811; and 3,902,872; and Printed German Application 1,021,116.

The composition of the product gas which is produced in the reactor depends in high degree on the composition of the gasifying agent.

The lower limit of the proportion of stream to be admixed with the free oxygen depends on the sintering and melting behavior of the ash contained in the fuel which is to be gasified.

Such reactors normally contain in their lower portion a substantially conical grate which is rotatably mounted and serves to discharge the gasification residue, which consists of ash in lump and/or granular form. The grate serves also to introduce the gasifying agent into the reactor shaft. The gasifying agent is normally supplied and distributed through a plurality of concentric annular slots in the top of the grate. A further distribution of the gasifying agent throughout the cross-section of the reactor shaft is accomplished by the ash bed lying on the top of the grate. The distribution will be improved by an ash bed having a uniform particle size and thickness.

The gasifying agent flowing through the ash bed takes up part of the sensible heat of the ash. This is beneficial for the gasification.

Any disturbance arising in the ash bed, e.g., as a result of a discharge of ash at an excessively high or excessively low rate, or an increase or decrease of the particle size of the ash, etc., will immediately affect the gasification.

It has been found in operation that the particle size of the ash depends not only on the composition of the gasifying agent but also on the distribution of the gasifying agent in the combustion zone of the reactor.

The use of the previously known grates did not result in an optimum distribution of the gasifying agent throughout the shaft area but in a preferential supply to the central region of the shaft. The increased supply of gasifying agent to the central region of the shaft results in a more intense combustion in that region so that the highest combustion temperatures which can be reached in theory are more closely approximated and the formation of slag is thus promoted whereas the composition of the fuel ash and the melting and sintering behavior of such ash are not changed.

On the other hand, the annular portion of the combustion zone near the shaft wall is suplied with less gasifying agent and is more intensely cooled. Fuel which has not been gasified can travel along the shaft wall to a region which is closely above the grate and from the latter region into the deadburnt ash thereby being lost.

This phenomenon also has an influence on the rate at which ash is discharged, with repercussions on the gas production rate and the composition of the product gas. For instance, when a formation of slag has resulted in a retention of ash, the grate may be rotated at a higher speed to crush the ash and the discharge of crushed slag may be suddenly succeeded by a discharge of ash from the reactor shaft at an excessively high rate. In that case the core of the combustion zone will descend too close to the grate so that the grate is locally overheated and may be damaged. In any case, the distribution of the gasifying agent leaving the top of the grate will be even less uniform so that any irregularities, such as an inclination of the surface of the ash bed, or a generation of steam in the jacket at a high and fluctuating rate, will be intensified. The output of the reactor will then decrease for hours, and the proportion of unburnt fuel in the ash will rise steeply, whereas the carbon dioxide content in the product gas will increase at the expense of its combustion constituents. The temperatures at the gas outlet of the reactor will also be higher than normal. In that case there is a danger of a channeling of free oxygen.

High gas outlet temperatures and slag-clogged grates often require an interruption of operation.

Because difficulties of that kind may arise, the operators must be highly attentive and must be highly skilled so that they can recognize the position and state of the combustion zone within the reactor. The structural alterations which have been adopted in the past have not basically improved the performance of the gasification process.

SUMMARY OF THE INVENTION

It has now been found that the difficulties which arise in the operation of the known gas producers can be avoided and a stable gasification can be ensured even in case of load changes and variations of the ash content and the properties of the ash if the measures taught by the invention are adopted.

These reside in that:

(1) The gasifying agent which contains free oxygen is positively distributed by the grate in a quantitative distribution which is in correspondence with the increase of the quantity of fuel in the radial direction of the shaft, i.e., the gasifying agent to supplied at a higher rate near the shaft wall, so that the time of contact between the gas and fuel is more uniform throughout the shaft area;

(2) By a variation of the proportion of water vapor admixed with the gasifying agent, the oxygen concentration of the gasifying agent is caused to vary over the cross-section of the reactor chamber in such a manner that a gasifying agent having a lower oxygen concentration and a higher water vapor content is preferentially supplied to the central region of the reactor cross-section;

(3) Steam produced in the jacket is admixed with the gasifying agent to be supplied to the central region of the reactor cross-section;

(4) Concentric annular shoulders provided on the top of the grate obstruct the movement of fuel and ash from the central region of the reactor to the shaft wall so that more ash is withdrawn from the outer zones of the reactor, i.e., from the zones which are supplied with more gasifying agent;

(5) For the same reason the shaft is conical and flares downwardly toward the grate in such a manner that a generatrix of the shaft wall has a taper of about 1:40 to 1:70 so that an optimum influence is exerted on the movement of the fuel and ash. This is particular important for the gasification of fuels which have a tendency to cake and swell.

BRIEF DESCRIPTION OF THE DRAWINGS

An illustrative embodiment of the pressure gassification reactor and the rotary grate contained therein will now be explained with reference to the accompanying drawing, which is a schematic sectional view of the grate region of a gasification reactor.

DETAILED DESCRIPTION OF THE PREFERRED EMBODIMENTS

The reactor housing consists of a concial shaft wall 1 and outer wall 2, which define between them a cooling water jacket. A conical rotary grate 3 has a top which is composed of interdigitating and overlapping elements. Chambers 10 for the distribution of a gasifying agent are disposed under the top of the grate inside the grate housing. By said chambers, the gasifying agent is positively distributed in correspondence with the quantity of fuel, which increases in the radial direction of the shaft, whereby a rather uniform time of contact between the gas and fuel is obtained over the shaft area. The gasifying agent is thus distributed to be proportional to the height of the fuel in the shaft. Additionally the concentration of free oxygen in the gasifying agent increases in the direction from the center of the reactor shaft to the shaft wall, and the stream generated in the jacket of the reactor is fed into the central region of the reactor shaft preferably together with gasifying agent.

Slots 3 shown as concentric rings serve to discharge the gasifying agent and are disposed between elements 7 of the top of the grate. The elements overlap in such a manner that fuel to be gasified and/or ash cannot enter the interior of the grate.

The grate is centrally mounted and is driven by means of a drive shaft 5. Scrapers 4 are arranged under the grate body and move the ash from the shaft into an ash duct 9, in which they fall into a pressure-equalizing lock chamber, not shown.

Gasifying agents mixed in different proportions are supplied to the interior of the grate by supply conduits *6a, 6b* (only two of them are shown) and are then distributed.

Steam generated in the jacket is conducted in supply conduit 8. Before said steam is admixed with the gasifying agent which is discharged in the central region of the reactor, the steam cools the overlying top of the grate.

The annular shoulders 7 are about 30 to 80 mm, preferably about 40 to 50 mm, high and obstruct an excessive removal of ash from the central region of the reactor shaft. The shoulders are rings with different diameters. Each grate has two to about 10 rings or shoulders. The rings are coaxial with each other and have the same vertical axis. The rings or shoulders are fastened at the upper surface of the grate as shown in the drawing.

What is claimed is:

1. In the continuous gasification of a fuel which is mainly in lump form comprising establishing a fixed bed of the fuel on a substantially conical rotary grate rotatably mounted in the lower portion of a shaft of a water-cooled reactor housing, subjecting the fuel at superatmospheric pressure to treatment with a gasifying agent containing free oxygen and at least one of water vapor and carbon dioxide, discharging the gasifying agent from said grate into said shaft, and removing gasification residue from the shaft, the improvement which comprises supplying gasifying agent to the central region of the grate and the shaft through a first conduit, and supplying gasifying agent to the outer region of the grate and the shaft through a second conduit, said outer region surrounding said central region and the free oxygen concentration in said outer region being higher than in said central region.

2. A process according to claim 1, further comprising generating steam from the cooling water in the jacket of the reactor and feeding same into the central region of the reactor shaft together with gasifying agent.

3. A process according to claim 1, further comprising conducting steam generated in the jacket to cool the central portion of the top of the grate and thereafter mixing the steam with the gasifying agent.

4. A process according to claim 1, further comprising obstructing the removal of ash on the grate from the central portion of the reactor shaft by annular shoulders provided on the top of the grate.

5. A process according to claim 1, wherein the shell of the shaft flares conically from the upper portion of the reactor toward the grate and its generatrices have a taper of about 1:40 to 1:70.

6. A process according to claim 1, wherein the shell of the shaft flares conically from the upper portion of the reactor toward the grate and its generatrices have a taper of about 1:40 to 1:70, the process further comprising generating steam in the jacket and feeding same into the central region of the reactor shaft with the gasifying agent to cool the central portion of the top of the grate before the steam is admixed with the gasifying agent, and obstructing the removal of ash on the grate from the central portion of the reactor shaft by annular shoulders provided on the top of the grate.

* * * * *